US008001907B2

(12) United States Patent
Hein

(10) Patent No.: US 8,001,907 B2
(45) Date of Patent: Aug. 23, 2011

(54) SYSTEM, METHOD AND APPARATUS FOR EASER RAIL THAT MATES WITH THE UNCUT WEB OF A RUNNING RAIL

(75) Inventor: Russell R. Hein, Denison, TX (US)

(73) Assignee: Progress Rail Services Corp, Albertville, AL (US)

( * ) Notice: Subject to any disclaimer, the term of this patent is extended or adjusted under 35 U.S.C. 154(b) by 0 days.

(21) Appl. No.: 12/169,158

(22) Filed: Jul. 8, 2008

(65) Prior Publication Data

US 2010/0006664 A1 Jan. 14, 2010

(51) Int. Cl.
*B61D 3/00* (2006.01)

(52) U.S. Cl. ..... 105/243; 105/174; 105/152; 105/149

(58) Field of Classification Search ..... 238/149, 238/159, 243, 248
See application file for complete search history.

(56) References Cited

U.S. PATENT DOCUMENTS

| | | | | | |
|---|---|---|---|---|---|
| 476,165 | A | | 5/1892 | O'Shea | |
| 1,057,881 | A | * | 4/1913 | Robiohaux | 238/174 |
| 1,186,737 | A | | 6/1916 | Bohannan | |
| 1,665,906 | A | | 4/1928 | Bohannan | |
| 2,441,329 | A | * | 5/1948 | Payne | 238/155 |
| 2,574,474 | A | * | 11/1951 | Gieskieng | 246/246 |
| 2,670,136 | A | * | 2/1954 | Moses | 238/155 |
| 2,873,918 | A | | 2/1959 | Rosebrook | |
| 3,658,245 | A | * | 4/1972 | Nelson | 238/151 |
| 3,952,948 | A | * | 4/1976 | Nelson et al. | 238/243 |
| 4,168,817 | A | | 9/1979 | Pirker et al. | |
| 4,466,570 | A | * | 8/1984 | Howard | 238/153 |
| 4,485,967 | A | * | 12/1984 | Edwards | 238/226 |
| 4,637,578 | A | * | 1/1987 | Frank | 246/391 |
| 5,503,331 | A | * | 4/1996 | Uramson et al. | 238/152 |
| 5,842,637 | A | * | 12/1998 | Lanzer | 238/152 |
| 6,000,624 | A | * | 12/1999 | Marron | 238/174 |
| 6,068,196 | A | * | 5/2000 | Benenowski et al. | 238/171 |
| 6,672,516 | B1 | * | 1/2004 | Skoutelas | 238/174 |
| 6,732,980 | B2 | * | 5/2004 | Hein | 246/455 |
| 2004/0065784 | A1 | * | 4/2004 | Hein | 246/468 |
| 2006/0027674 | A1 | * | 2/2006 | Urmson et al. | 238/243 |
| 2008/0035749 | A1 | * | 2/2008 | Igwenezie | 238/243 |

* cited by examiner

*Primary Examiner* — S. Joseph Morano
*Assistant Examiner* — Jason C Smith
(74) *Attorney, Agent, or Firm* — Miller, Matthias & Hull

(57) ABSTRACT

An easer rail is mated with the uncut web of a fixed running rail to form a more rigid thermal expansion joint between the fixed rail and a moveable rail. The easer rail has an extension that protrudes into the uncut web the fixed rail. The easer rail extension is machined to be complementary in shape to the uncut web and fits tightly against the flange, the underside of the head, and the base of the uncut web of the fixed rail. Bolt holes are provided through the extension and the easer rail, its extension, and the fixed rail to form multiple bolt joints. The bolted extension not only lengthens the easer rail but locks it in place between the head and base of the fixed rail to provide additional rigidity.

14 Claims, 10 Drawing Sheets

SYSTEM, METHOD AND APPARATUS FOR EASER RAIL THAT MATES WITH THE UNCUT WEB OF A RUNNING RAIL

BACKGROUND OF THE INVENTION

1. Technical Field

The present invention relates in general to railroad track bridge disengagement systems and, in particular, to a system, method and apparatus for mating easer rails with the uncut webs of fixed running rails at intersections with moveable railroad bridges.

2. Description of the Related Art

An easer rail system, also known as a miter rail system, permits a moveable section of railroad track to join with a fixed section of railroad track. Easer rails are used to carry wheels over a gapped joint section that is used to allow bridge movement and to compensate for thermal expansion and contraction by providing a small space between the ends of moveable and fixed rails.

Applications for easer rails include the moveable portions of railroad bridges. Some railroad bridges that are relatively close the waterway that they traverse have movable decks to allow ships to pass by or beneath them. Such bridges include vertical lift bridges, bascule bridges and swing bridges. A vertical lift bridge is similar to an elevator, as it raises and lowers a bridge deck while maintaining the deck in a horizontal orientation. A bascule bridge only lifts one end of the bridge deck, such that the bridge deck pivots about its opposite end. Finally, a swing bridge always keeps the bridge deck horizontal, but it typically rotates the bridge deck about its mid-section.

As shown in FIGS. 1-3, a conventional easer rail system provides a thermal expansion joint 10 (or gap) between the ends of a fixed rail 11 and a moveable rail 13. The joint is formed with all easer rail 15 that attaches to the fixed rail 11 and partially overlaps but freely releases the end 17 of the moveable rail 13. The ends of the easer rail 15 and the fixed rail 11 overlap each other with smooth vertical surfaces 19, 21 (FIG. 3), respectively, that are cut or machined into their respective ends. Thus, at the expansion joint 10, the track cross-section is made up of the machined moveable rail 13 and the easer rail 15, which cooperate together to provide suitable support for the rolling stock wheels of trains.

The easer rail 15 is bolted 23 directly to the mating vertical surface 21 on the fixed rail 11. Bolt holes are provided through the easer rail 15 and the vertical surface 21 of the fixed rail 11, and a bolted joint is formed between them. As best shown in FIGS. 1 and 3, the smooth vertical surface 19 of the easer rail 15 strictly interfaces with both the fixed rail 11 and the moveable rail 13. Although this design is workable, an improved system, method and apparatus for mating easer rails with fixed running rails at intersections with moveable railroad bridges would be desirable.

SUMMARY OF THE INVENTION

Embodiments of an improved system, method, and apparatus for mating an easer rail with the uncut web of a fixed running rail are disclosed. The joint between the easer rail and the fixed rail is improved by providing an extension on the easer rail end that is more intimately secured to the fixed rail. The extension extends the easer rail into the unnotched, uncut web (i.e., fishing area) or the unmachined portion the fixed rail. Further, the rail ends adjacent the rail expansion gap may be sloped to minimize potential wheel impacts on the ends of the rails.

The easer extension is formed or machined to be complementary in shape to the uncut web and fits tightly against the base or flange, the underside of the head, and the web of the unnotched portion of the fixed rail. Bolt holes are provided through the extension and the fixed rail to form additional bolt joints. The bolted extension not only lengthens the easer rail but mechanically locks it in place between the head and base of the fixed rail to provide additional rigidity for the easer rail assembly.

In an alternate embodiment, the easer rail may be supported on a riser. The easer rail may be formed from a 175-pound crane rail section. This installation may comprise a rolled, high carbon steel rail section, and may be provided with a hardened head. This design is very robust and includes substantial mass or material that allows it to be machined for this easer rail design embodiment.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Referring to FIGS. 4-15, embodiments of a system, method and apparatus for mating easer rails with the uncut webs of fixed running rails at intersections between fixed and moveable rails are shown. For example, the invention is well suited for applications having moveable portions on railroad bridges. Such bridges may include vertical lift bridges, bascule bridges and swing bridges, as are known to those of ordinary skill in the art.

As shown in FIGS. 4-7 and 12-13, one embodiment of the invention comprises an easer rail assembly for suitable applications, such as a vertical lift or bascule type bridge. In the embodiment shown, the easer rail assembly may be installed on a pair of fixed rails 41 that are mounted to plates 43, and a pair of aligned movable rails 45 (e.g., on a moveable portion of a bridge) that are mounted to plates 47. The plates 43, 47 may be secured to railroad ties or other conventional support means.

Figure 1:
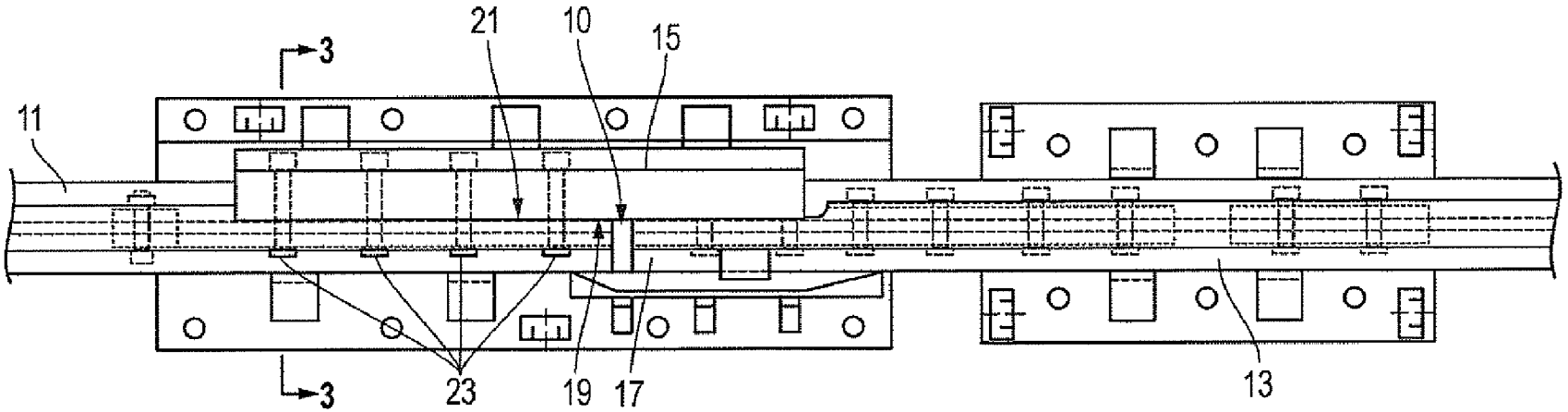
FIG. 1 (Prior Art)
FIG. 1 is a top view of a conventional easer rail installation.
Figure 2:
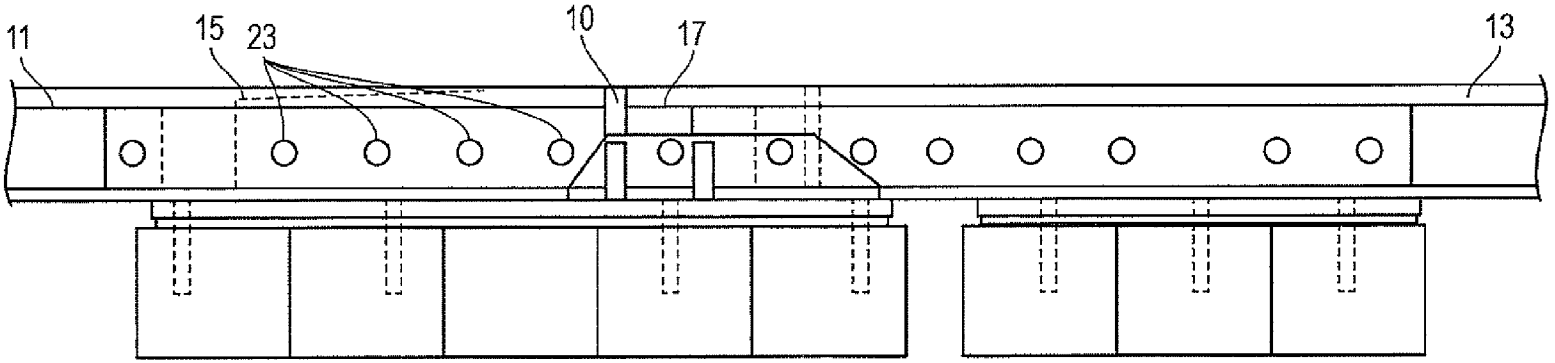
FIG. 2 (Prior Art)
FIG. 2 is a side view of the easer rail installation of FIG. 1.
Figure 3:
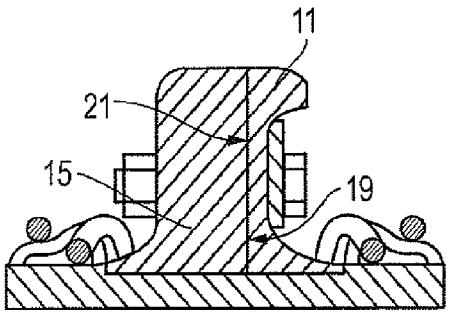
FIG. 3 (Prior Art)
FIG. 3 is a sectional end view of the easer rail installation of FIG. 1, taken along the lines 3-3 of FIG. 1.
Figure 4:
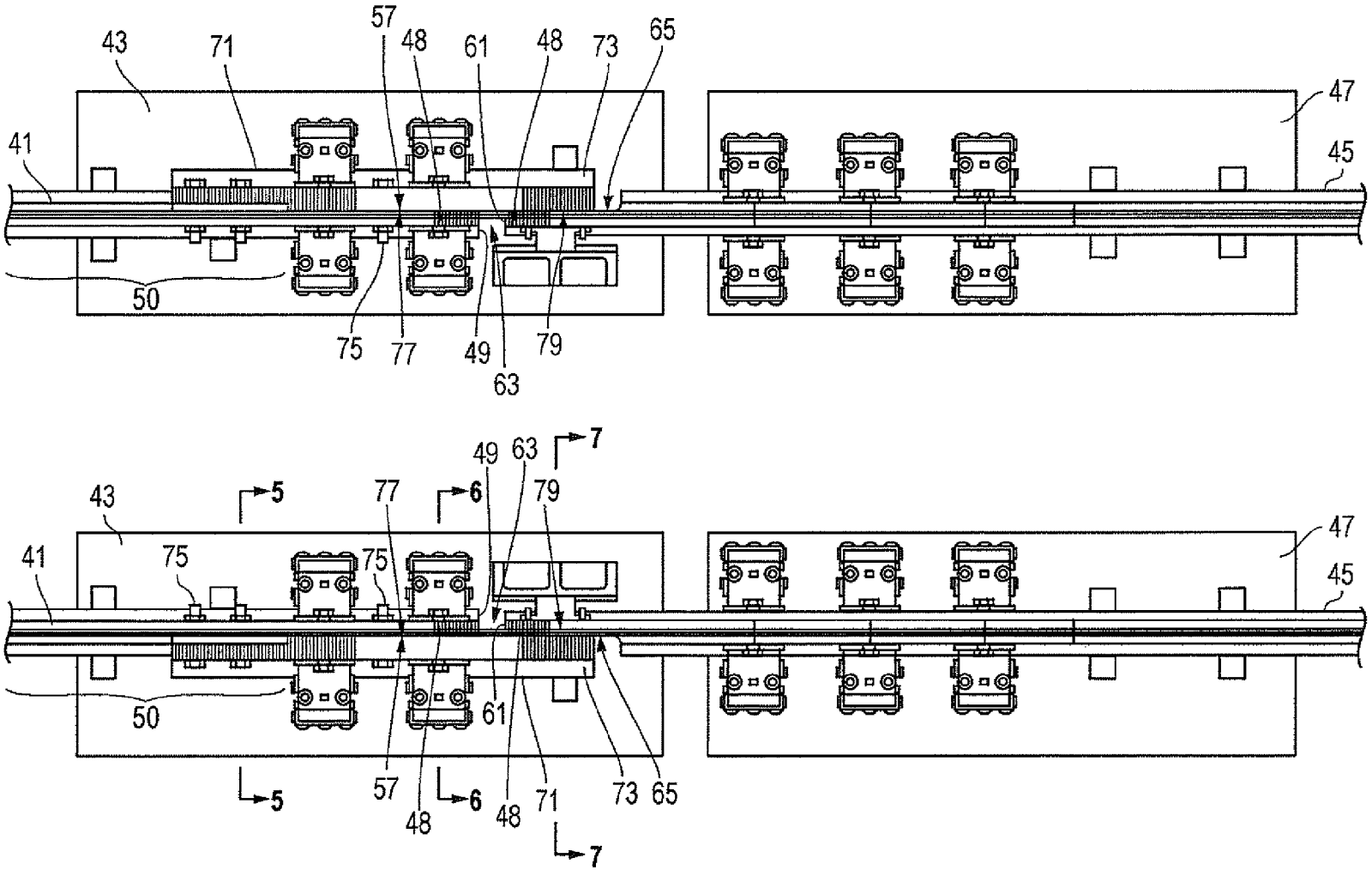
FIG. 4 is a top view of one embodiment of an easer rail installation constructed in accordance with the invention.

As shown in FIG. 4, the fixed and lift ends 49, 61, respectively, adjacent the rail expansion gap 63 may be provided with slopes 48 as shown to minimize potential wheel impacts on the ends of the rails. For example, each slope 48 may comprise a reduction in elevation (i.e., vertically or transversely) of one-quarter inch over six inches in rail length (i.e., longitudinally), with the lowest points of each slope 48 occurring adjacent to gap 63. This design reduces wear on fixed and lift ends 49, 61 as wheels travel on the easer rails 71 between the fixed rails 41 and movable rails 45.

Figure 6:
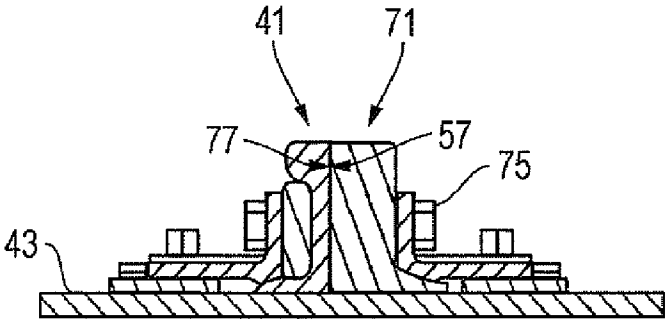
FIG. 6 is a sectional end view of the easer rail installation of FIG. 4, taken along the line 6-6 and is constructed in accordance with the invention.
Figure 13:
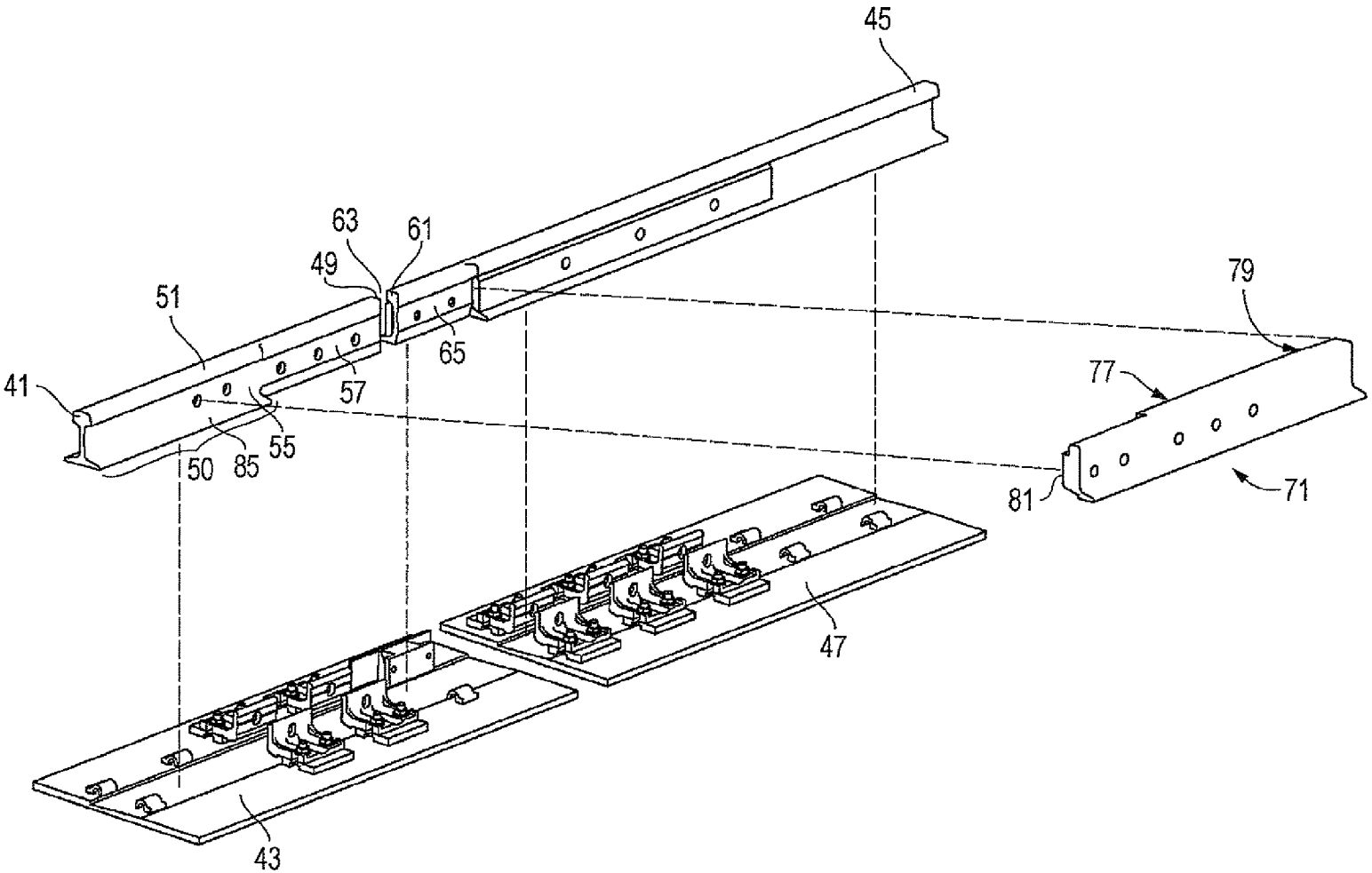
Figure 14:
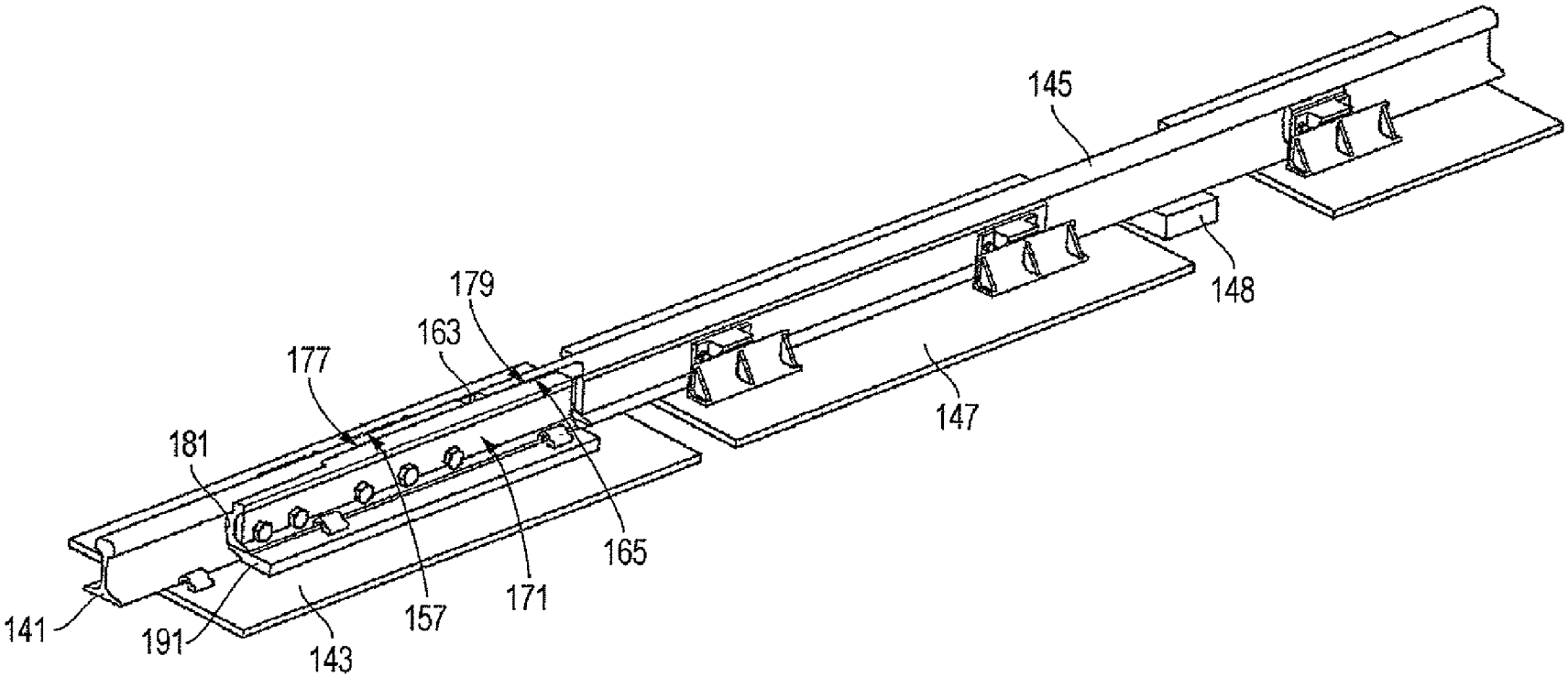
FIGS. 14 and 15 are isometric and exploded views, respectively, of the embodiment of FIGS. 8-11, and is constructed in accordance with the invention.

The fixed and moveable rails 41, 45 extend in a longitudinal direction and are spaced apart from each other in the longitudinal direction. Each fixed rail 41 has a conventional rail section 50 with a head 51 (FIG. 5), a base or flange 53, and a web 55. The web 55 extends in a transverse (i.e., vertical) direction that is substantially perpendicular to the longitudinal and lateral directions between the head 51 and the flange 53. As shown in FIGS. 4, 6 and 13, each fixed rail 41 also has a fixed surface or "flat" 57 that is substantially vertical and located between the fixed end 49 and the rail section 50, extending in the transverse direction.

As described herein, the easer rail assembly also comprises the lift rails 45, which are longitudinally aligned with but moveable relative to the fixed rails 41. Each lift rail 45 has a lift end 61 (FIG. 13) that is longitudinally spaced apart from the fixed end 49 to define the longitudinal space or gap 63 between the fixed rail 41 and the lift rail 45. Like the fixed rails 41, each of the lift rails 45 has a lift surface 65 or flat that is vertical and located adjacent to its respective lift end 61.

Figure 7:
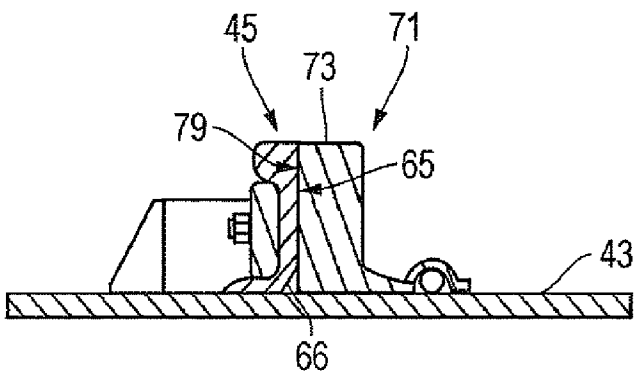
FIG. 7 is a sectional end view of the easer rail installation of FIG. 4, taken along the line 7-7 and is constructed in accordance with the invention.
Figure 12:
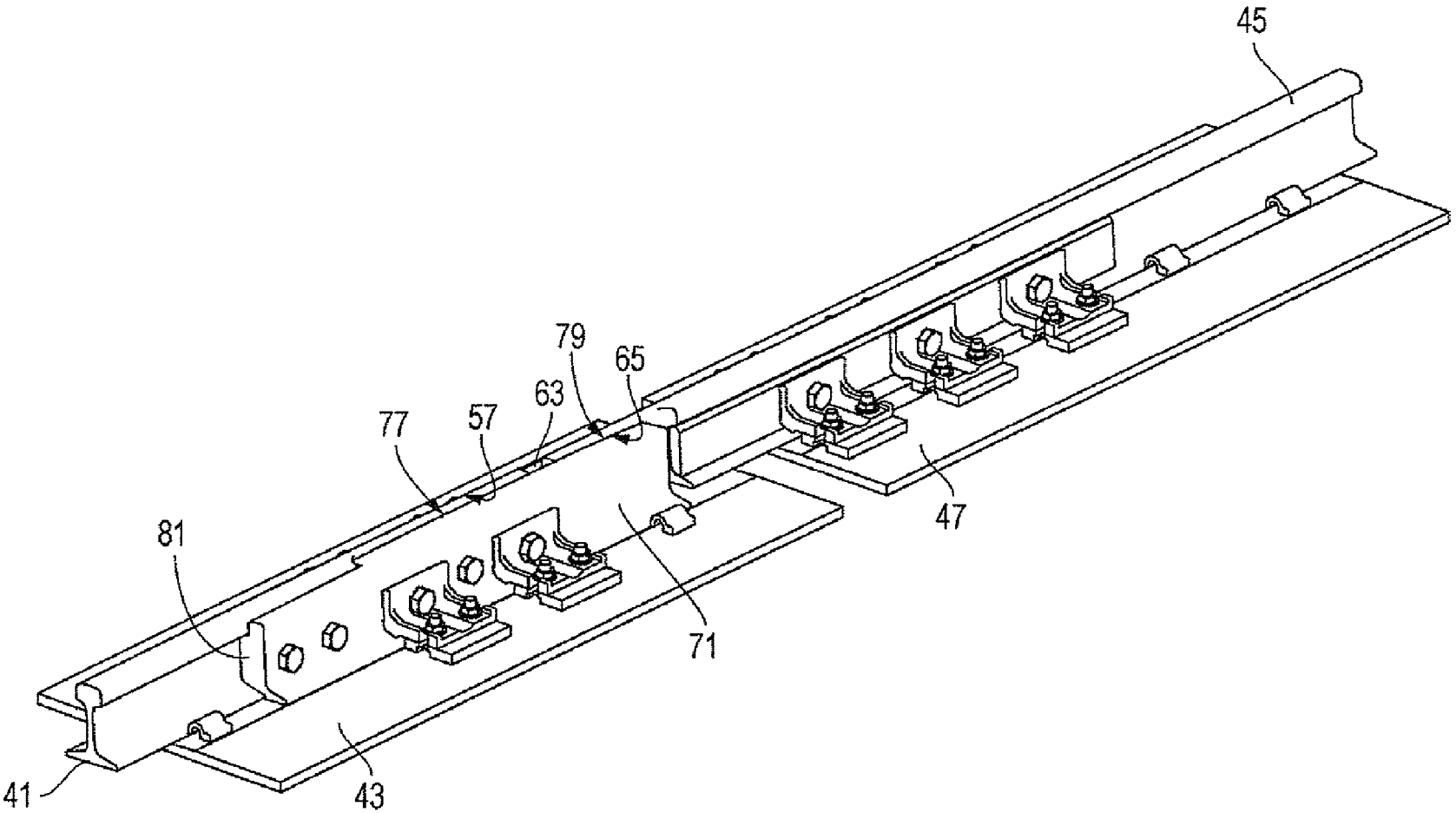
FIGS. 12 and 13 are isometric and exploded views, respectively, of the embodiment of FIGS. 4-7, and is constructed in accordance with the invention.

In the embodiments illustrated, easer rails 71 are respectively mounted to the fixed rails 41 at both the rail sections 50 (i.e., bolted 75 into webs 55; see, e.g., FIG. 5) and further down the line at the fixed surfaces 57 (FIG. 6). Each easer rail 71 has an easer end 73 that extends longitudinally from the fixed rail 41 beyond the lift end 61 of the lift rail 45. In one embodiment, each easer rail 71 is bolted to the rail section 50 of the fixed rail 41 with two bolts 75, and to the fixed surface 57 of the fixed rail 41 with three bolts 75. Each of the bolts 75 may be provided with a diameter of 1⅜-inches for additional rigidity. As shown in FIGS. 7 and 12, the easer ends 73 are movably engaged by the lift surfaces 65 of the lift rails 45, but are not bolted to them.

Referring again to FIGS. 4, 6, and 13, each easer rail 71 has an easer fixed surface 77 (e.g., vertical flat) that abuts a respective fixed surface 57. Each easer rail 71 also has an easer lift surface 79 (e.g., vertical flat) that movably engages the lift surface 65. As shown in FIG. 7, the lift surface 65 of lift rail 45 is provided with a sloped lower end 66 that may be machined one-half inch laterally inward (i.e., to the left in FIG. 7) from surface 65 over a two-inch transverse (i.e., vertical) span, and along 15 longitudinal inches of lift rail 45. This feature avoids interference between the components during movement operations.

Figure 5:
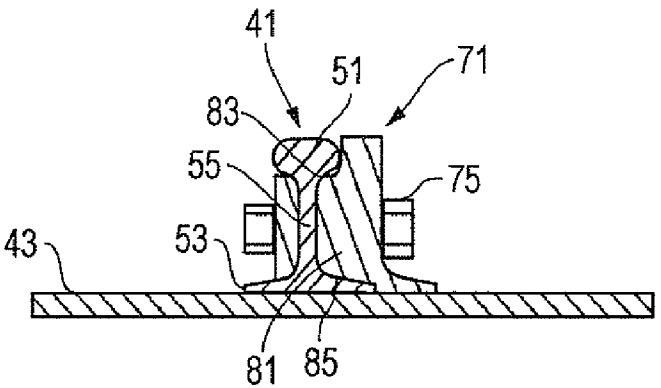
FIG. 5 is a sectional end view of the easer rail installation of FIG. 4, taken along the line 5-5 and is constructed in accordance with the invention.

As shown in FIGS. 5, 12 and 13, each easer rail 71 also has a protrusion 81 and recesses 83, 85 that are complementary in shape to and closely received by the head 51, flange 53 and web 55 of the rail section 50 of the fixed rail 41. These features may extend in the transverse direction and in a lateral direction that is substantially perpendicular to both the longitudinal and transverse directions.

FIGS. 8-11 and 14-15 depict another embodiment of the invention comprising easer rails 171 for suitable applications, such as a swing span bridge. In this embodiment, the fixed rails 141 are mounted to and supported by fixed plates 143, and a riser 191 is located between each easer rail 171 and fixed plate 143. The lift rails 145 are mounted to plates 147, and may be provided with a lift mechanism 148 for moving at least portions of lift rails 145. A space 163 is located between rails 141, 145. To reduce the complexity of the drawings, this embodiment is shown without plate clips.

Figure 8:
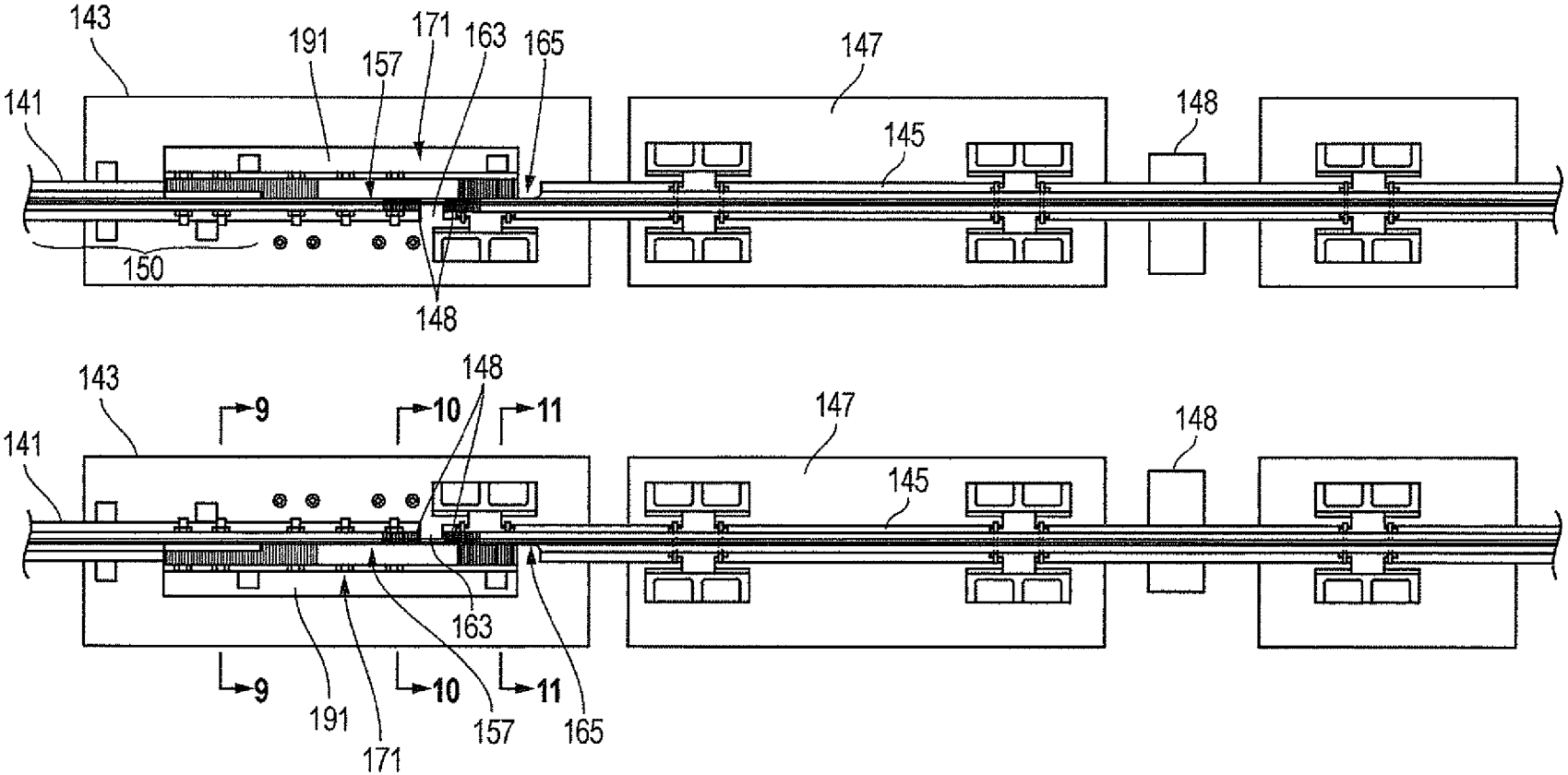
FIG. 8 is a top view of another embodiment of an easer rail installation constructed in accordance with the invention.
Figure 10:
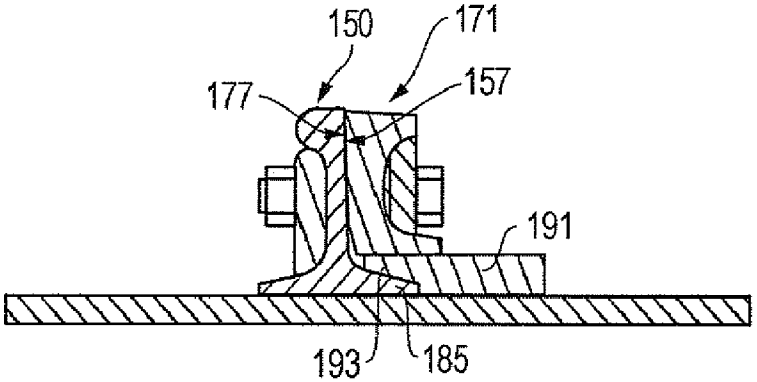
FIG. 10 is a sectional end view of the easer rail installation of FIG. 8, taken along the line 10-10 and is constructed in accordance with the invention.
Figure 9:
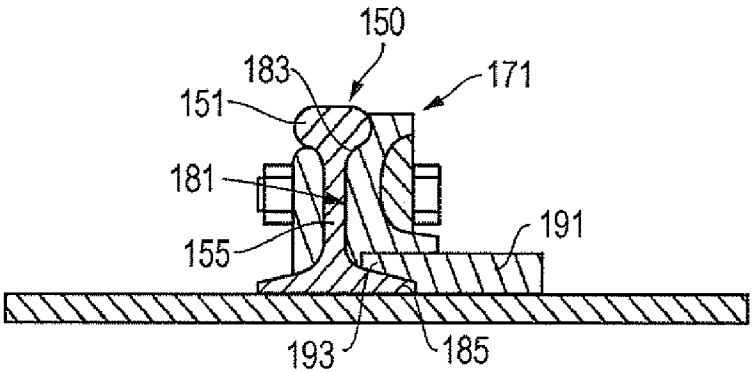
FIG. 9 is a sectional end view of the easer rail installation of FIG. 8, taken along the line 9-9 and is constructed in accordance with the invention.

As shown in FIGS. 9 and 10, each riser 191 may be provided with a lip 193 that is located between its respective easer rail 171 and the flange 185 of the rail section 150 (FIG. 8) of fixed rail 141. The lip 193 may extend along its entire longitudinal length in contact with flange 185, such that flange 185 is unaltered from its conventional shape. Thus, this design only requires the formation of fixed surface 157 (FIGS. 10 and 15) on fixed rails 141 for engaging fixed easer surface 177. In some embodiments, slopes 148 (FIG. 8) also may be formed on the ends of rails 141, 145, as described above for the previous embodiments with regard to slopes 48.

Figure 11:
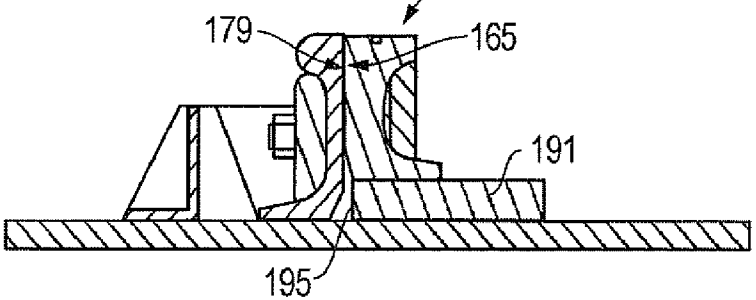
FIG. 11 is a sectional end view of the easer rail installation of FIG. 8, taken along the line 11-11 and is constructed in accordance with the invention.
Figure 15:
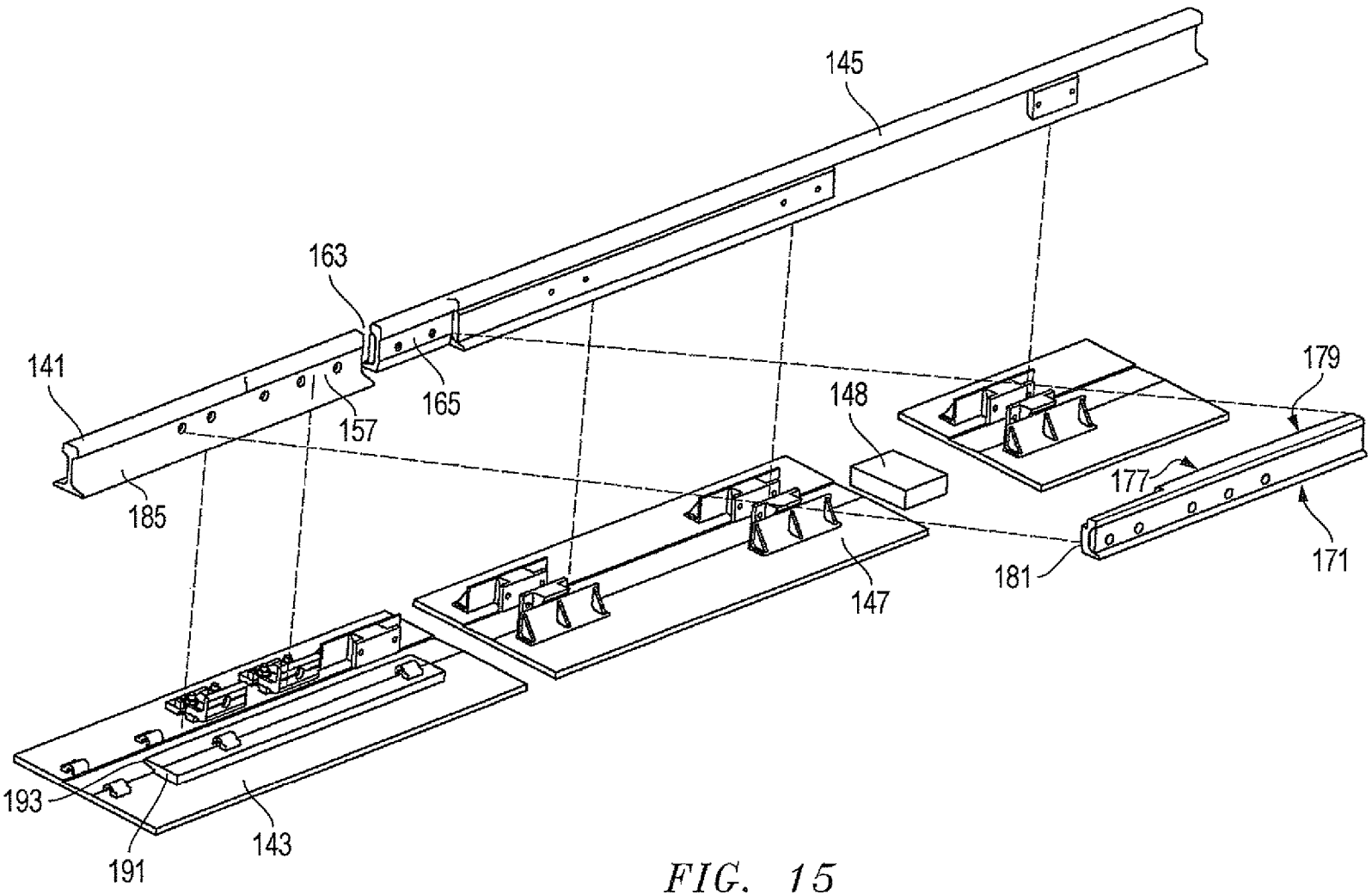

Each riser 191 also may be provided with a riser flat 195 (FIG. 11) that is free of contact with and laterally spaced apart from the lift surface 165 (FIGS. 8, 11 and 15). Easer lift surface 179 is provided for engaging lift surface 165. Like easer rail 71, easer rail 171 has protrusion 181 (FIGS. 9, 14 and 15) and recesses that are complementary in shape to and closely received by the head 151, flange 185 and web 155 of the fixed rail 141.

In one embodiment, the riser 191 supports a 175-pound crane rail section that may be formed from a rolled, high carbon steel rail section, and may be provided with a hardened head. This design is very robust and includes substantial mass or material that allows it to be machined for this easer rail embodiment. Other features, elements and advantages of this embodiment may be provided in similar or identical manners as those of the previously described embodiments.

The invention also comprises a method of forming an easer rail assembly. In one embodiment, the method comprises providing a fixed rail having a fixed end, a rail section with a head, a flange and a web between the head and the flange, and a fixed surface located between the fixed end and the rail section; aligning a lift rail with and moveable relative to the fixed rail, the lift rail having a lift end that is spaced apart from the fixed end, and a lift surface located adjacent the lift end; and mounting an easer rail to both the rail section and the fixed surface of the fixed rail, the easer rail having an easer end that extends beyond the lift end of the lift rail, and the easer end being movably engaged by the lift surface of the lift rail.

In other embodiments of the method, the mounting step may comprise bolting the easer rail to both the web of the rail section and the fixed surface of the fixed rail; and/or providing the easer rail with an easer fixed surface that abuts the fixed surface, an easer lift surface that movably engages the lift surface, and a protrusion and recesses that are complementary in shape to and closely received by the head, flange and web of the rail section of the fixed rail. The initial steps may comprise providing each of the fixed and lift rails with a slope adjacent the fixed and lift ends, respectively, each slope comprising a reduction in elevation with a lowest point of each slope occurring adjacent to a space between the fixed rail and the lift rail. In still another embodiment, the initial step further comprises mounting the fixed rail to a fixed plate, and then locating a riser between the easer rail and the fixed plate. The method may further comprise providing the riser with a lip located between the easer rail and the flange of the rail section, the riser also having a riser flat that is free of contact with the lift surface.

The invention provides several advantages by mating an easer rail with the uncut web of a fixed running rail. This joint is improved by providing an extension on the easer rail end that is more intimately secured to the fixed rail. The easer rail extension not only lengthens the easer rail but mechanically locks it in place between the head and base of the fixed rail to provide additional rigidity to prevent relative vertical movement of the easer rail assembly. The crane rail version may comprise a rolled, high carbon steel rail section, and may be provided with a hardened head. This design is very robust and includes substantial mass or material that allows it to be machined for this easer rail design embodiment. The invention has the additional advantages of lower cost and maintenance, and less material removal than other designs as the parent rail section has a shorter starting height prior to machining since it is supported on the riser section. Joint integrity is further enhanced with larger bolts (e.g., 1⅜-inch diameters) to provide significantly more (e.g., 2.5 times greater) clamping ability than conventional designs. In addition, the rail ends adjacent the rail expansion gap may be sloped to minimize potential wheel impacts on the ends of the rails.

While the invention has been shown or described in only some of its forms, it should be apparent to those skilled in the art that it is not so limited, but is susceptible to various changes without departing from the scope of the invention.

INDUSTRIAL APPLICABILITY

As explained herein, the system, method and apparatus for mating railroad easer rails with the uncut webs of fixed running rails according to the present invention are useful for railroad bridges, and are particularly useful for an intersections with moveable railroad bridges.

What is claimed is:

1. An easer rail assembly, comprising: a fixed rail having a fixed end, a rail section defining a non-planar profile with a head, a flange and a web between the head and the flange, and a fixed surface located between the fixed end and the rail section; a lift rail aligned with and moveable relative to the fixed rail, the lift rail having a lift end that is spaced apart from the fixed end, and a lift surface located adjacent the lift end; and an easer rail having a first section that is complementary in shape to and closely received by the non-planar profile of the head, flange, and web of the rail section, and a second section formed with an easer fixed surface that is complementary in shape to and closely received by the fixed surface of the fixed rail, the first section of the easer rail being mounted to the rail section and the second section of the easer rail being mounted to the fixed surface of the fixed rail, the easer rail further having a third section including an easer end that extends beyond the lift end of the lift rail, and the easer end being movably engaged by the lift surface of the lift rail.

2. An easer rail assembly according to claim 1, wherein the first section of the easer rail is bolted to the web of the rail section and the second section of the easer rail is bolted to the fixed surface of the fixed rail.

3. An easer rail assembly according to claim 1, wherein the first section of the easer rail is bolted to the rail section of the fixed rail with two bolts, the second section of the easer rail is bolted to the fixed surface of the fixed rail with three bolts, and each of the bolts has a diameter of 1⅜-inches.

4. An easer rail assembly according to claim 1, wherein the third section of the easer rail has an easer lift surface that movably engages the lift surface, and the first section of the easer rail includes a protrusion and recesses that are complementary in shape to and closely received by the head, flange and web of the rail section of the fixed rail.

5. An easer rail assembly according to claim 1, wherein each of the fixed and lift rails is provided with a slope adjacent the fixed and lift ends, respectively, each slope comprising a reduction in elevation with a lowest point of each slope occurring adjacent to a space between the fixed rail and the lift rail.

6. An easer rail assembly according to claim 1, further comprising:

a fixed plate to which the fixed rail is mounted, and a riser located between the easer rail and the fixed plate; and a plate to which the lift rail is mounted.

7. An easer rail assembly according to claim 6, wherein the riser has a lip located between the easer rail and the flange of the rail section, the riser also having a riser flat that is free of contact with the lift surface.

8. An easer rail assembly according to claim 1, wherein the easer rail is formed from a 175-pound crane rail section.

9. An easer rail assembly, comprising: a fixed rail extending in a longitudinal direction and having a fixed end, a rail section defining a non-planar profile with a head, a flange and a web, the web extending in a transverse direction that is substantially perpendicular to the longitudinal direction between the head and the flange, and a fixed vertical flat located between the fixed end and the rail section and extending in the transverse direction; a lift rail longitudinally aligned with and moveable relative to the fixed rail, the lift rail having a lift end that is longitudinally spaced apart from the fixed end to define a space in the longitudinal direction between the fixed rail and the lift rail, and a lift vertical flat located adjacent the lift end; and an easer rail having a first section that is complementary in shape to and closely received by the non-planar profile of the head, flange, and web of the rail section, and a second section formed with an easer fixed surface that is complementary in shape to and closely received by the fixed surface of the fixed rail, the first section of the easer rail being mounted to the web of the rail section and the second section of the easer rail being mounted to the fixed vertical flat of the fixed rail, the easer rail further having a third section including an easer end that extends beyond the lift end of the lift rail, and the easer end being movably engaged by the lift vertical flat of the lift rail.

10. An easer rail assembly according to claim 9, wherein the first section of the easer rail is bolted to the web of the rail section of the fixed rail with two bolts, the second section of the easer rail is bolted to the fixed vertical flat of the fixed rail with three bolts, and each of the bolts has a diameter of 1⅜-inches.

11. An easer rail assembly according to claim 10, wherein the first section of the easer rail has an easer fixed vertical flat that abuts the fixed vertical flat, the third section of the easer rail has an easer lift vertical flat that movably engages the lift vertical flat, and the second section of the easer rail has a protrusion and recesses that are complementary in shape to and closely received by the head, flange and web of the rail section of the fixed rail in the transverse direction and in a lateral direction that is substantially perpendicular to both the longitudinal and transverse directions.

12. An easer rail assembly according to claim 9, wherein each of the fixed and lift rails is provided with a slope adjacent the fixed and lift ends, respectively, each slope comprising a reduction in vertical elevation in the transverse direction of one-quarter inch over six inches in longitudinal rail length, with a lowest point of each slope occurring adjacent to the longitudinal space between the fixed rail and the lift rail.

13. An easer rail assembly according to claim 9, further comprising:

a fixed plate to which the fixed rail is mounted, and a riser located between the easer rail and the fixed plate; and a plate to which the lift rail is mounted.

14. An easer rail assembly according to claim 13, wherein the riser has a lip located between the easer rail and the flange of the rail section, the riser has a riser flat that is free of contact with the lift vertical flat, and the easer rail is formed from a 175-pound crane rail section.

* * * * *